US010760222B2

(12) United States Patent
Manton et al.

(10) Patent No.: US 10,760,222 B2
(45) Date of Patent: Sep. 1, 2020

(54) SYSTEM, METHOD AND APPARTUS FOR IN-SITU, DYNAMIC REPAIR OF A RAILROAD

(71) Applicant: BNSF Railway Company, Fort Worth, TX (US)

(72) Inventors: Tracey Manton, Fort Worth, TX (US); Mike Schlueter, Fort Worth, TX (US); Paul Rudolph, Fort Worth, TX (US); James Cole, Fort Worth, TX (US); Trevor Johnson, Fort Worth, TX (US); Rod Nelson, Fort Worth, TX (US); Corey Rakow, Fort Worth, TX (US)

(73) Assignee: BNSF Railway Company, Fort Worth, TX (US)

( * ) Notice: Subject to any disclaimer, the term of this patent is extended or adjusted under 35 U.S.C. 154(b) by 263 days.

(21) Appl. No.: 16/024,281

(22) Filed: Jun. 29, 2018

(65) Prior Publication Data

US 2019/0316299 A1 Oct. 17, 2019

Related U.S. Application Data

(60) Provisional application No. 62/658,422, filed on Apr. 16, 2018.

(51) Int. Cl.

| | |
|---|---|
| ***E01B 27/10*** | (2006.01) |
| ***E01B 29/10*** | (2006.01) |
| ***E01B 27/02*** | (2006.01) |
| ***E01B 29/04*** | (2006.01) |

(52) U.S. Cl.

CPC ..... *E01B 27/025* (2013.01); *E01B 29/04* (2013.01)

(58) Field of Classification Search

CPC ..... E01B 29/04; E01B 27/026; E01B 27/105; E01B 27/10; E01B 27/025; E01B 27/023; E01B 31/04

USPC ..... 37/104, 107, 347; 104/2, 7.1, 7.3, 3, 9; 171/16, 130

See application file for complete search history.

(56) References Cited

U.S. PATENT DOCUMENTS

| | | | | |
|---|---|---|---|---|
| 3,811,382 A * | 5/1974 | Buchter | E01B 27/021 | 104/7.3 |
| 3,818,619 A * | 6/1974 | Plasser | E01B 27/105 | 37/104 |
| 4,266,615 A * | 5/1981 | Theurer | E01B 27/105 | 104/2 |
| 4,444,345 A * | 4/1984 | Solomon | B26F 3/002 | 104/7.1 |

(Continued)

OTHER PUBLICATIONS

"Tie Remover/Inserter", Nordco, available before Feb. 22, 2018, 2 pages.

*Primary Examiner* — Robert E Pezzuto

(57) ABSTRACT

A device for in-situ, dynamic repair of a railroad can include two connected machines. A first one of machines can be a track lifting unit that can clamp the rails of the railroad and lift the track in its entirety out of its track bed. The first machine also can plow ballast away from and/or toward the rails, and level the track bed for the rails before they are lowered. In addition, the track lifting unit can remove selected railroad ties. The second machine can include a power unit that can provide hydraulic, pneumatic and electrical power to both machines. The power unit also can provide track stabilization by settling ballast and can free debris from the railroad while it is raised.

29 Claims, 14 Drawing Sheets

(56) References Cited

U.S. PATENT DOCUMENTS

| | | | | | |
|---|---|---|---|---|---|
| 4,611,541 | A * | 9/1986 | Theurer | ..... | E01B 27/105<br>104/2 |
| 4,967,847 | A * | 11/1990 | Whitaker, Jr. | ..... | E01B 27/10<br>104/7.3 |
| 5,090,484 | A * | 2/1992 | Theurer | ..... | E01B 27/026<br>104/2 |
| 9,938,669 | B2 * | 4/2018 | Boyd | ..... | E01B 27/025 |

* cited by examiner

SYSTEM, METHOD AND APPARTUS FOR IN-SITU, DYNAMIC REPAIR OF A RAILROAD

This application claims priority to and the benefit of U.S. Prov. Pat. App. No. 62/658,422, filed Apr. 16, 2018, and is incorporated herein by reference in its entirety.

BACKGROUND OF THE INVENTION

Field of the Disclosure

The present invention relates in general to railroad equipment and, in particular, to a system, method and apparatus for in-situ, dynamic repair of a railroad.

Description of the Prior Art

A railroad typically includes a track mounted in ballast in a rail bed. The railroad can be become worn or damaged over time, such that the track is "slow ordered" (i.e., reduced speed limit) or goes completely out of service. For example, railroads can be damaged by floods to reduce their usability. There are several conventional ways of repairing such railroads. Repair techniques can include the use of autotrack sleds, power cars that can lift damaged track and track stabilizers for settling the ballast in the rail bed, such as those known in the art. Although these techniques are workable, improvements in railroad repair continue to be of interest.

SUMMARY

Embodiments of a system, method and apparatus for in-situ, dynamic repair of a railroad are disclosed. For example, a railroad apparatus for a railroad having a track in a rail bed can include an operations car comprising a grader configured to grade the rail bed beneath the track in a working direction while the track is vertically elevated above the rail bed by the operations car. The grader can include a first degree of freedom in a lateral direction with respect to the railroad, a second degree of freedom in a vertical direction with respect to the railroad, and a third degree of freedom rotationally about a vertical axis with respect to the railroad. In addition, the railroad apparatus can include a power car coupled to the operations car. The power car can include hydraulic, pneumatic and electric systems configured to provide hydraulic power, pneumatic power and electric power, respectively, to both the operations car and the power car.

The foregoing and other objects and advantages of these embodiments will be apparent to those of ordinary skill in the art in view of the following detailed description, taken in conjunction with the appended claims and the accompanying drawings.

BRIEF DESCRIPTION OF THE DRAWINGS

So that the manner in which the features and advantages of the embodiments are attained and can be understood in more detail, a more particular description may be had by reference to the embodiments thereof that are illustrated in the appended drawings. However, the drawings illustrate only some embodiments and therefore are not to be considered limiting in scope as there may be other equally effective embodiments.

The use of the same reference symbols in different drawings indicates similar or identical items.

DETAILED DESCRIPTION

Embodiments of a system, method and apparatus for expediting the process of regaining the integrity of "slow ordered" (i.e., reduced speed limit) or "out of service" railroad track, and/or a track that has been or has the potential of being impacted by flood damage are disclosed. For example, the versions disclosed herein can do one or more of the following: vertically lift the track up to a desired elevation, grade and level the track-bed surface, maintain proper track alignment, move ballast from track shoulder locations to below the track, provide ballast pre-settlement, include a removal system for ties, such as drop ties or defective ties, incorporate a means of dust suppression where applicable. In addition, embodiments can be self-propelled and utilize a drive system that can provide one or more of sufficient means of propelling the machine in both travel and work scenarios, provide machine-towing capability for mobilization between work sites, and perform its purpose(s) more efficiently and cost effectively than other means that have been attempted previously.

Figure 1:
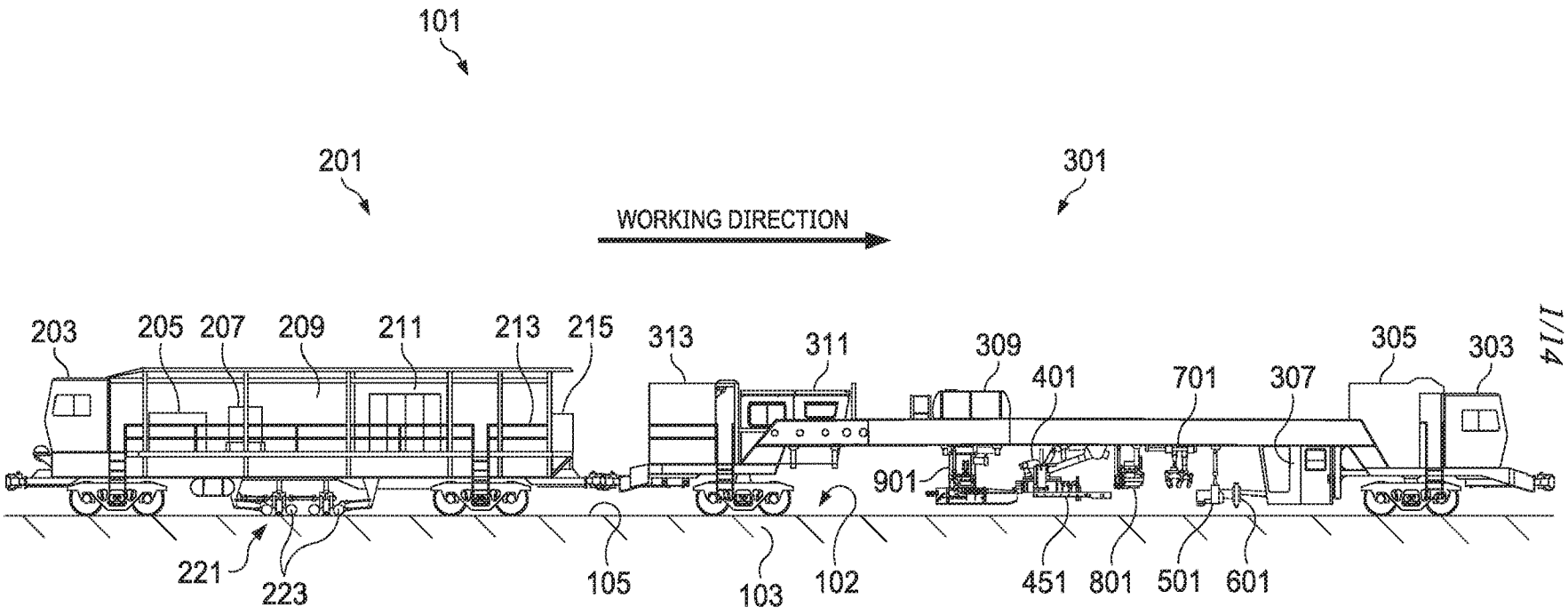
FIG. 1 is a side view of one embodiment of a railroad apparatus having a power car and an operations car, with some equipment shown in retracted or non-operational position such as when the railroad apparatus is not in operation.

FIG. 1 depicts an embodiment of a railroad apparatus 101 for a railroad 102 having a track 105. The railroad apparatus 101 can include a power car 201 and an operations car 301. In some versions, the railroad apparatus 101 consists only of the power car 201 and the operations car 301. The power car 201 can be coupled to the operations car 301. Examples of the power car 201 can include hydraulic, pneumatic and electric systems configured to provide hydraulic power, pneumatic power and electric power, respectively, to both the operations car 301 and the power car 201.

Embodiments of the railroad apparatus 101 can be configured to move at a railroad repair speed of at least about 0.5 miles per hour (mph), at least about 1.0 mph, or even at least about 1.5 mph. Versions of railroad apparatus 101 can be configured to vertically lift the track 105 from its original vertical height and out of the rail bed 103 by at least about 8 inches, at least about 10 inches, at least about 12 inches, at least about 14 inches, or even at least about 16 inches. In addition, the railroad apparatus 101 can comprise or consist of eight drive axles (e.g., four on the power car 201, and four on the operations car 301) having wheels, and each of the eight drive axles can be individually and selectively drivable by the power car 201.

Figure 2:
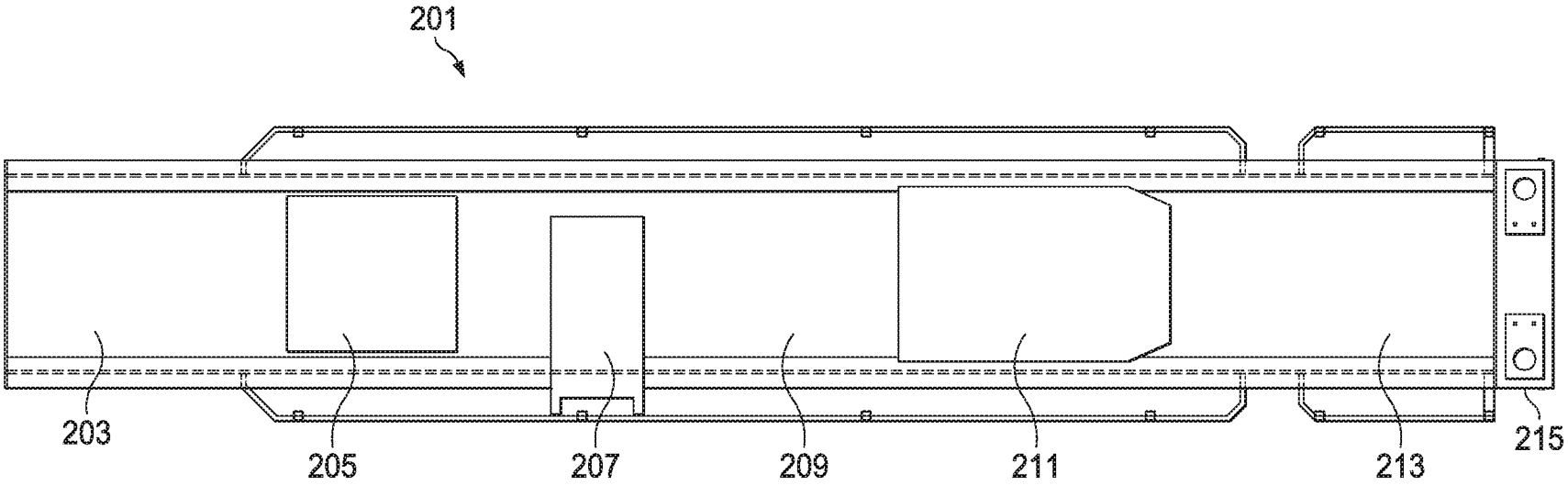
FIG. 2 is a plan view of one embodiment of a power car for the railroad apparatus of FIG. 1.

As shown in FIGS. 1 and 2, the power car 201 can include a variety of components and systems. For example, the power car 201 can include at least one of a cab 203, a fuel tank 205, a generator 207, a valve bank area 209 (such as for a compressor), an engine 211 (e.g., a diesel engine with an air starter), a pump drive 213 or a hydraulic tank 215. The power car 201 can include hydraulic, pneumatic and electric systems configured to provide hydraulic power, pneumatic power and electric power, respectively, to both the power car 201 and to the operations car 301.

In addition, the power car 201 can include a track stabilizer 221 (FIG. 1) that is fully integrated into the power car 201. The track stabilizer 221 can include in-situ workheads 223 that are configured to apply selected vibration (e.g., horizontal vibration) and load (e.g., vertical load) directly beneath the power car 201 to the railroad while the railroad apparatus 101 is in operation. In some versions, the track stabilizer 221 can settle and compact ballast in the rail bed 103 and loosen debris from the track 105. This can be done while the track 105 is elevated above the rail bed 103 by the railroad apparatus 101. Examples of the functionality of some embodiments of the track stabilizer 221 can be at least somewhat similar to the PTS62 Dynamic Track Stabilizer, by Plasser American Corporation of Chesapeake, Va.

Embodiments of the operations car 301 can include a variety of components, utility and functionality. For example, the operations car 301 can include one or more of a front cab 303, a work shop 305, a lifter cab 307, a dust suppression water tank 309, a plow cab 311 or storage 313. In addition, the operations car 301 can further include one or more of a main lifter 401 (FIG. 1), a grader 451, an additional lifter 501, a tie decoupler 601, a tie extractor 701, a first plow 801 or a second plow 901. In some versions, each of the tie decouplers 601, tie extractors 701, sides (i.e., on sides of the track 105) of the first plow 801, grader 451 and sides of the second plow 901 can be independently actuatable relative to each other through respective degrees of freedom.

Figure 3:
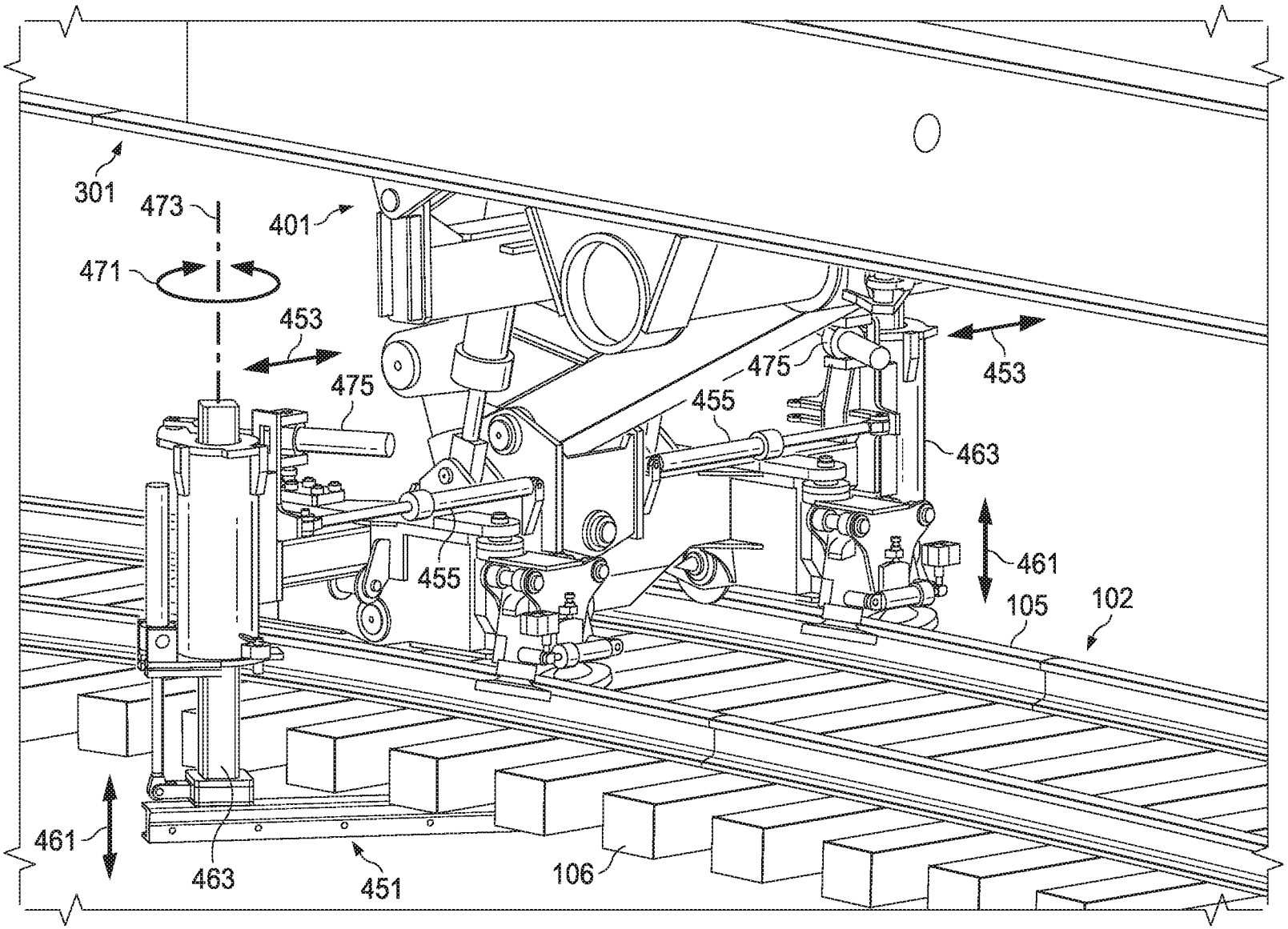
FIG. 3 is an enlarged isometric view of a main lifter of an operations car, schematically shown in operation.
Figure 4:
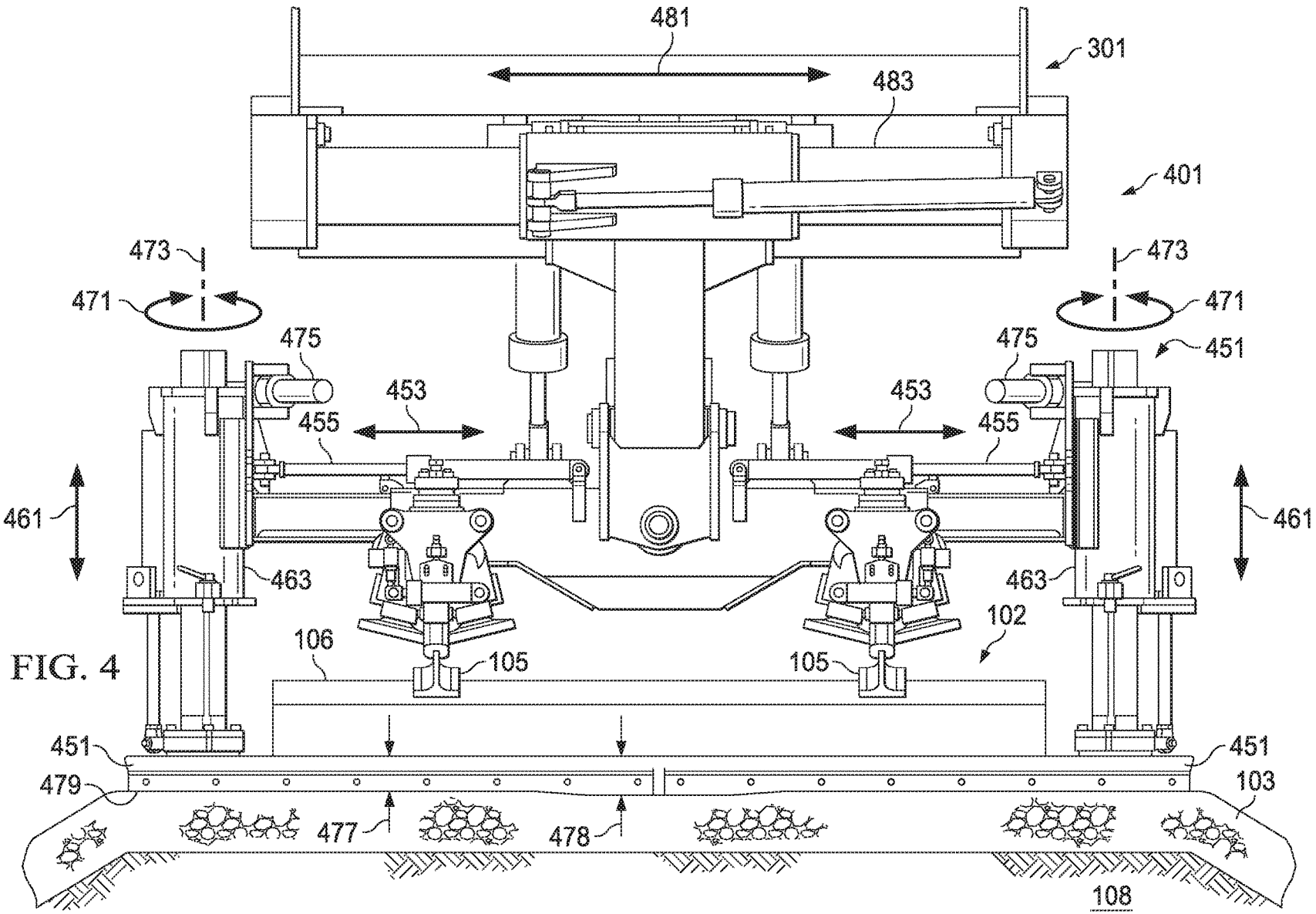
FIG. 4 is a front view of the main lifter of FIG. 3.
Figure 5:
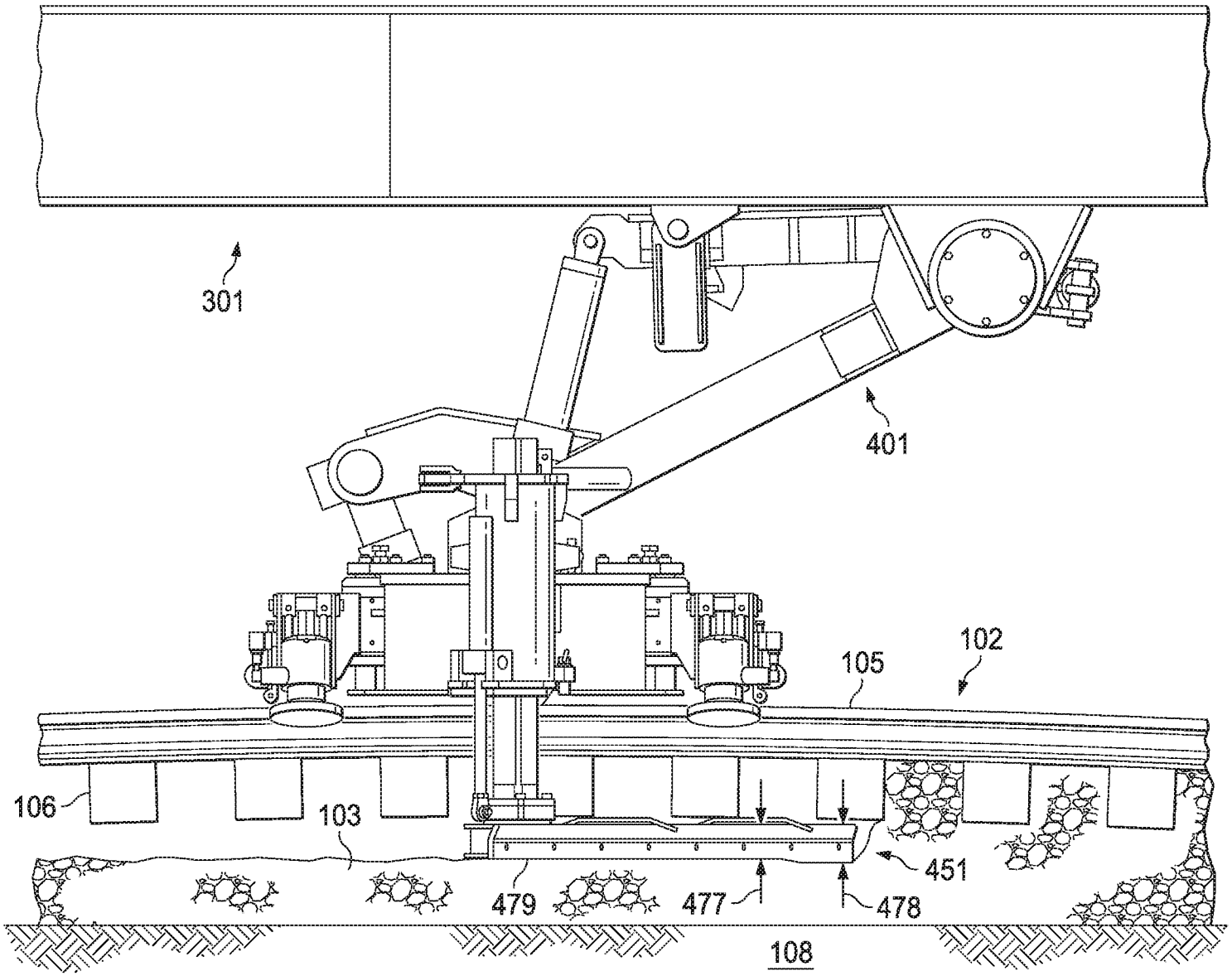
FIG. 5 is a side view of the main lifter of FIG. 3.

As shown in FIGS. 3-5, versions of the operations car 301 can include the main lifter 401 to vertically elevate the track 105 above the rail bed 103. Embodiments of the operations car 301 also can be configured to use the additional lifter 501 to vertically elevate the track 105 above the rail bed 103. The main lifter 401 can be located rearward of the additional lifter 501 relative to the working direction of the railroad apparatus. The additional lifter 501 can be configured to break the track 105 loose from ballast in the rail bed 103. In some embodiments, the main lifter 401 can be spaced apart (e.g., such as rearward, relative to the working direction) from the additional lifter 501 by a distance in a range of about 5 feet to about 25 feet.

Embodiments of the main lifter 401 can include a greater amount of vertical elevation capacity than the additional lifter 501. For example, the main lifter can have a maximum vertical lift of about 17 inches. In another example, the additional lifter 501 can have a maximum vertical lift of about 10 inches. Embodiments of the operations car 301 can further include the lifter cab 307 being mounted to the operations car 301 forward of the additional lifter 501 relative to the working direction.

Figure 6:
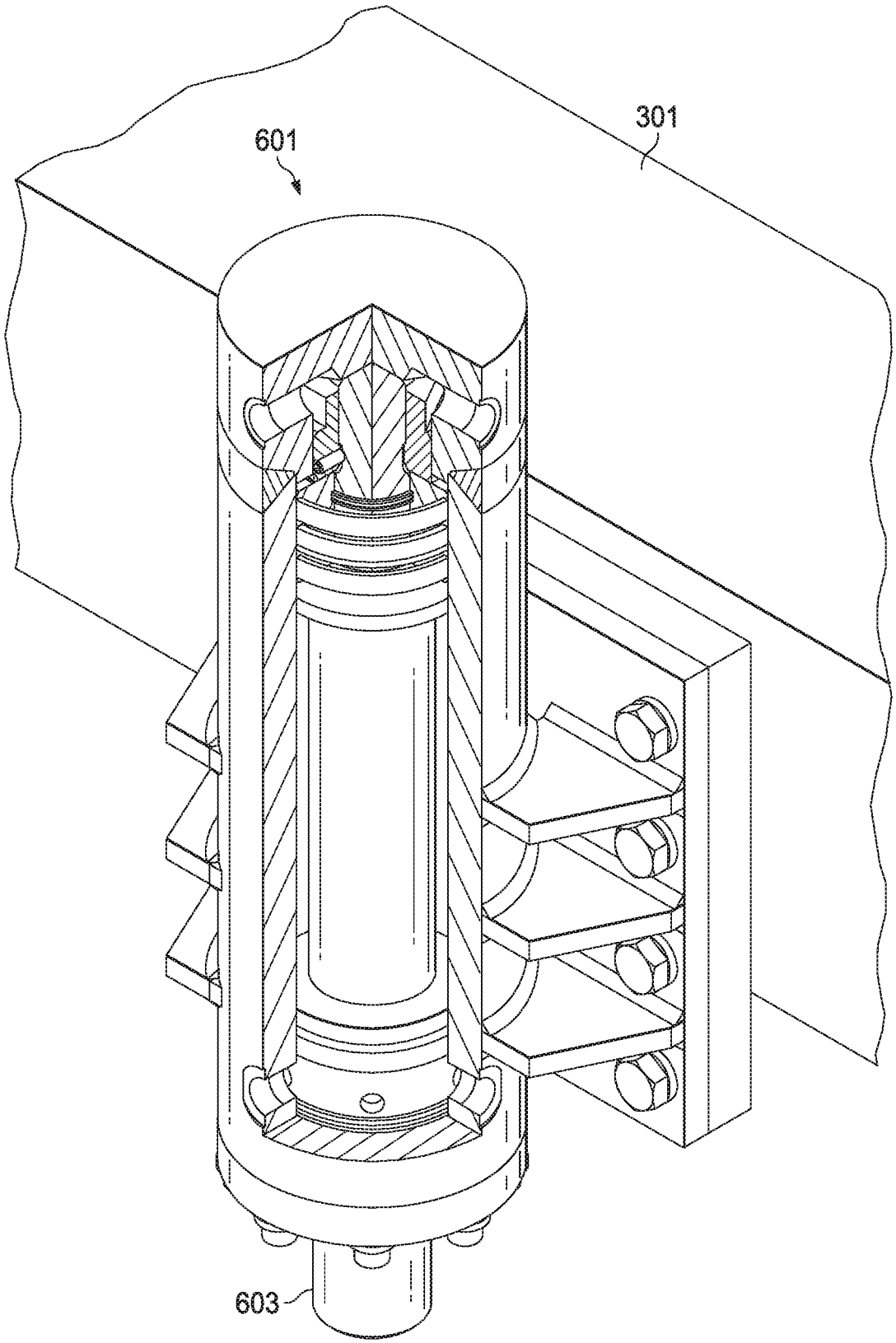
FIG. 6 is partially-sectioned, isometric view of a tie decoupler mounted to the operations car.

In some examples, one or more of the tie decouplers 601 (FIGS. 1 and 6; e.g., two shown, for each side of the track 105) can be mounted to the operations car 301 between the additional lifter 501 and the lifter cab 307. In the version shown, one tie decoupler 601 is located adjacent each lateral side of the operations car 301 and directly facing the lifter cab 307, as shown in FIG. 1. Examples of each tie decoupler 601 can be configured to remove a tie 106, via a hydraulic piston 603, from the track 105 while the track 105 is lifted out of the rail bed 103. Each tie decoupler 601 can decouple one side of a tie 106 from the track 105 by extending the hydraulic piston 603 therefrom by pushing the respective side of the tie 106 off of the track 105 with the hydraulic piston 603.

As noted herein, embodiments of the operations car 301 can include the grader 451 (FIGS. 3-5) that can be coupled to main lifter 401. Versions of the grader 451 can be substantially aligned with and mounted to the main lifter 401 relative to the working direction of the railroad apparatus. Examples of the grader 451 can be configured to grade the rail bed 103 (e.g., ballast) of a railroad 102 beneath the track 105 thereof in the working direction (in FIG. 1, left to right). Grader 451 can grade the rail bed 103 while the track 105 is vertically elevated above the rail bed 103 by the operations car 301. Versions of the grader 451 can include a first degree of freedom 453 in a lateral direction (e.g., side to side, or horizontally, with respect to the working direction) with respect to the railroad 102. The first degree of freedom 453 can be provided by actuators 455 that can extend between the main lifter 401 and the grader 451, such as on both lateral sides of the main lifter 401.

In addition, the grader 451 can have a second degree of freedom 461 in a vertical direction with respect to the railroad 102. The second degree of freedom 461 can be provided by actuators 463 that are located at lateral sides of the main lifter 401. In one version, the actuators 463 for the second degree of freedom 461 can move the sides of the grader 451 vertically.

Embodiments of the grader 451 can have a third degree of freedom 471 rotationally about a vertical axis 473 with respect to the railroad 102. In an example, the third degree of freedom 471 can be provided by actuators 475, which can be coupled to the assembly that provides actuators 463. In another example, the grader 451 can further include a fourth degree of freedom 481 (see, e.g., FIG. 4) wherein entireties of both the grader 451 and the main lifter 401 are movable in lateral or transverse directions (e.g., side to side, or horizontally) relative to the working direction. The main lifter 401 and, thus, grader 451 can be adjustably mounted to hydraulic piston 483 for this purpose.

Versions of the operations car 301 can be configured to substantially remove tie memory in the ballast due to previous locations of the ties 106 lifted from the rail bed 103. The operations car 301 also can be configured to lower the track to a top of the rail bed 103 to skeletonize the track 105 after the tie memory is substantially removed. In some examples, the grader 451 does not comprise a chain. During operation, versions of the grader 451 are not rotated (i.e., like a chain) while the rail bed 103 is being graded. In addition, during grading, examples of the grader 451 do not intentionally on-board ballast of the rail bed 103 (i.e., load ballast onto the railroad apparatus 101), the grader 451 does not intentionally sift the rail bed 103, and the grader 451 does not intentionally off-board sifted rail bed 103 (i.e., unload ballast from the railroad apparatus 101).

During grading, embodiments of the grader 451 can be configured to contact only a limited vertical depth of a ballast of the rail bed 103. In particular, examples of the grader 451 can be configured to not contact and disrupt a hard pack 108 (FIG. 4) of the rail bed 103 that supports the ballast.

Embodiments of the grader 451 can include two graders (as shown) that are spaced apart from each other on opposite sides of the operations car 301. Each grader 451 can include a vertical dimension 477 (FIGS. 4 and 5) that varies laterally with respect to the railroad 102. In some versions, a distal end 478 of each grader 451 can include a larger vertical dimension than a proximal end 479 of each grader 451.

Figure 14:
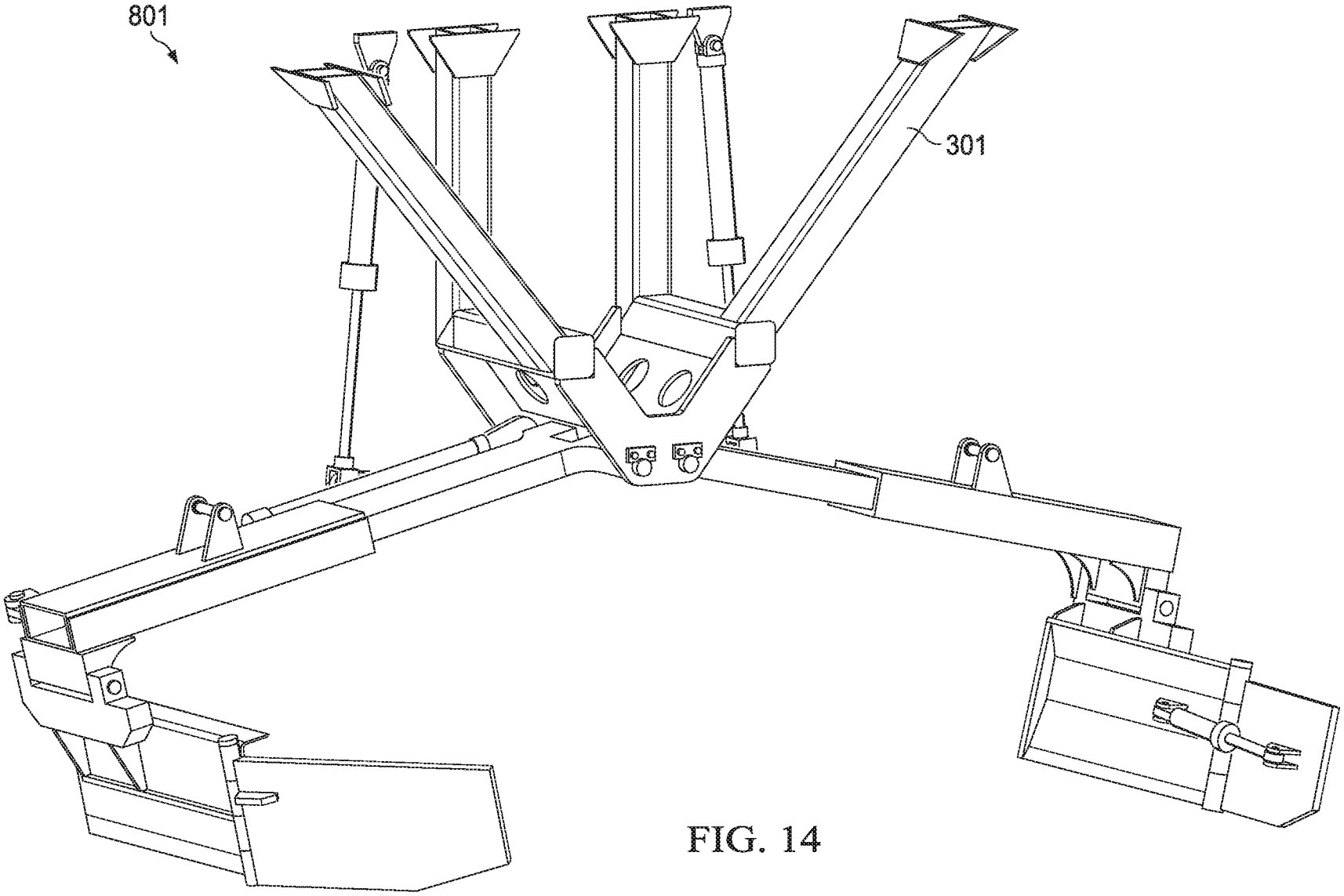
FIG. 14 is a front isometric view of an embodiment of a plow for the railroad apparatus, with the plow shown in a deployed or operational configuration for use during operation of the railroad apparatus.

Examples of the railroad apparatus 101 can further include the first plow 801 (FIGS. 1 and 14) on operations car 301. Embodiments of the first plow 801 can be located forward of the grader 451 relative to the working direction. Versions of the first plow 801 can be configured to move the ballast of the rail bed 103 adjacent ends of ties 106 of the track 105 laterally outward, away from the ties. The first plow 801 can include features, elements and functions similar or even identical to those described herein for the second plow 901.

Figure 7:
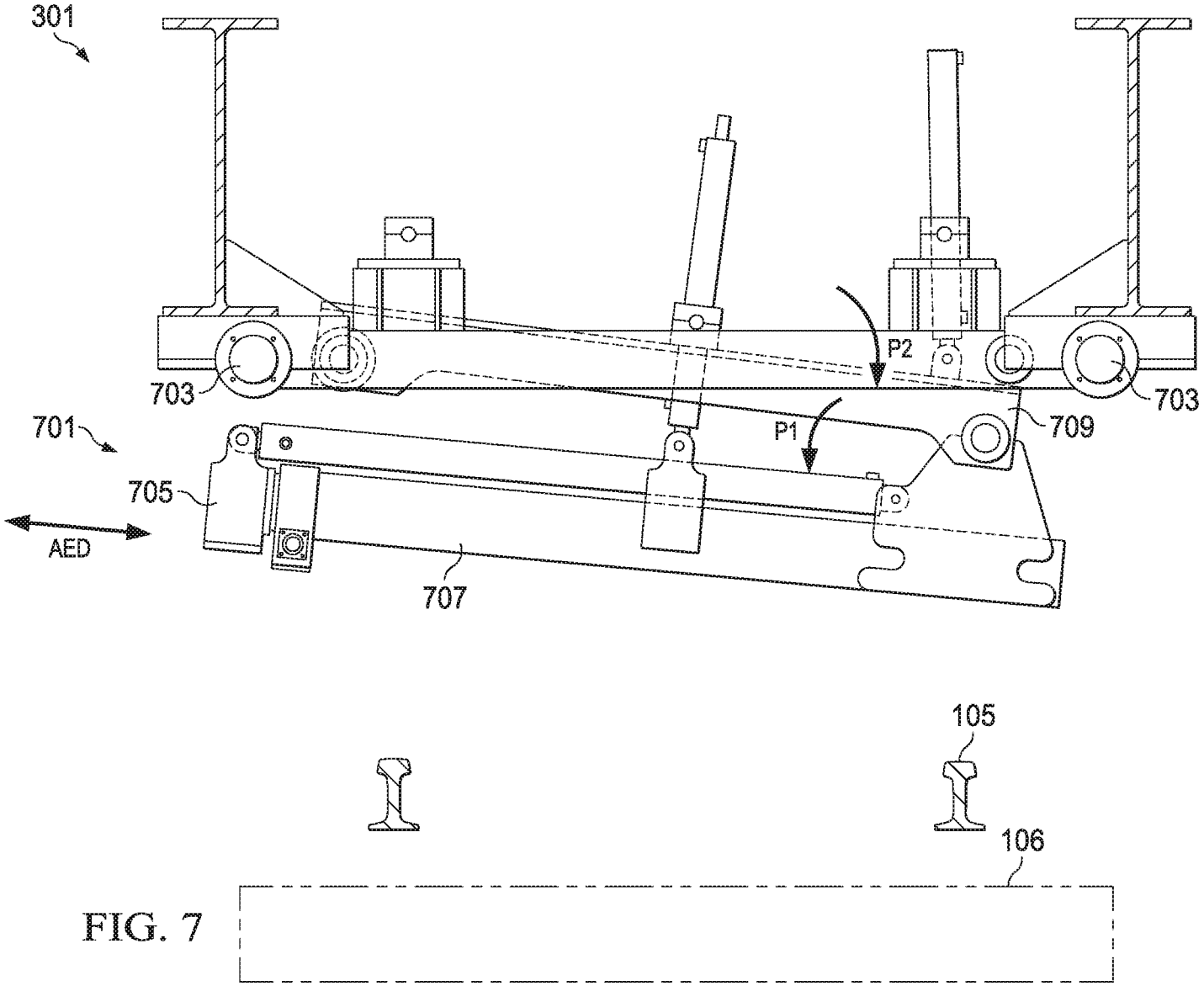
FIG. 7 is a partially-sectioned front view of a tie extractor mounted to the operations car.
Figure 8:
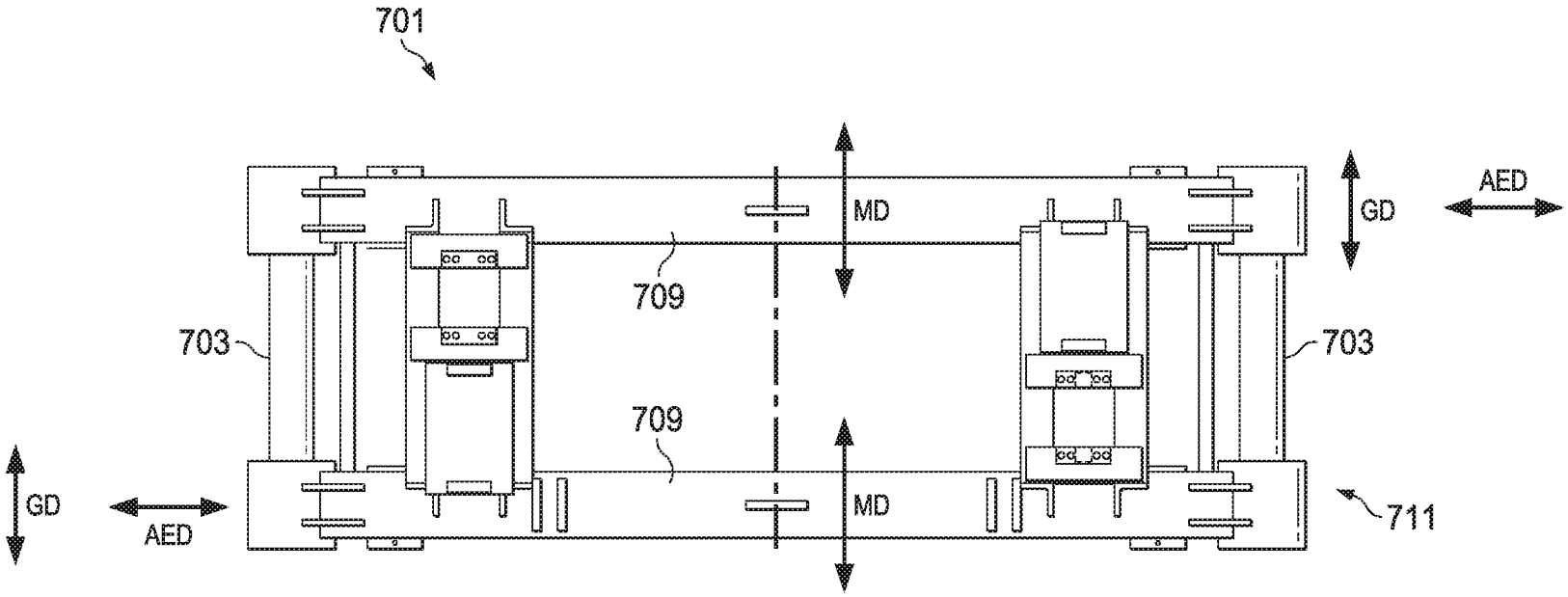
FIG. 8 is a top view of a portion of the tie extractor of FIG. 7.
Figure 9:
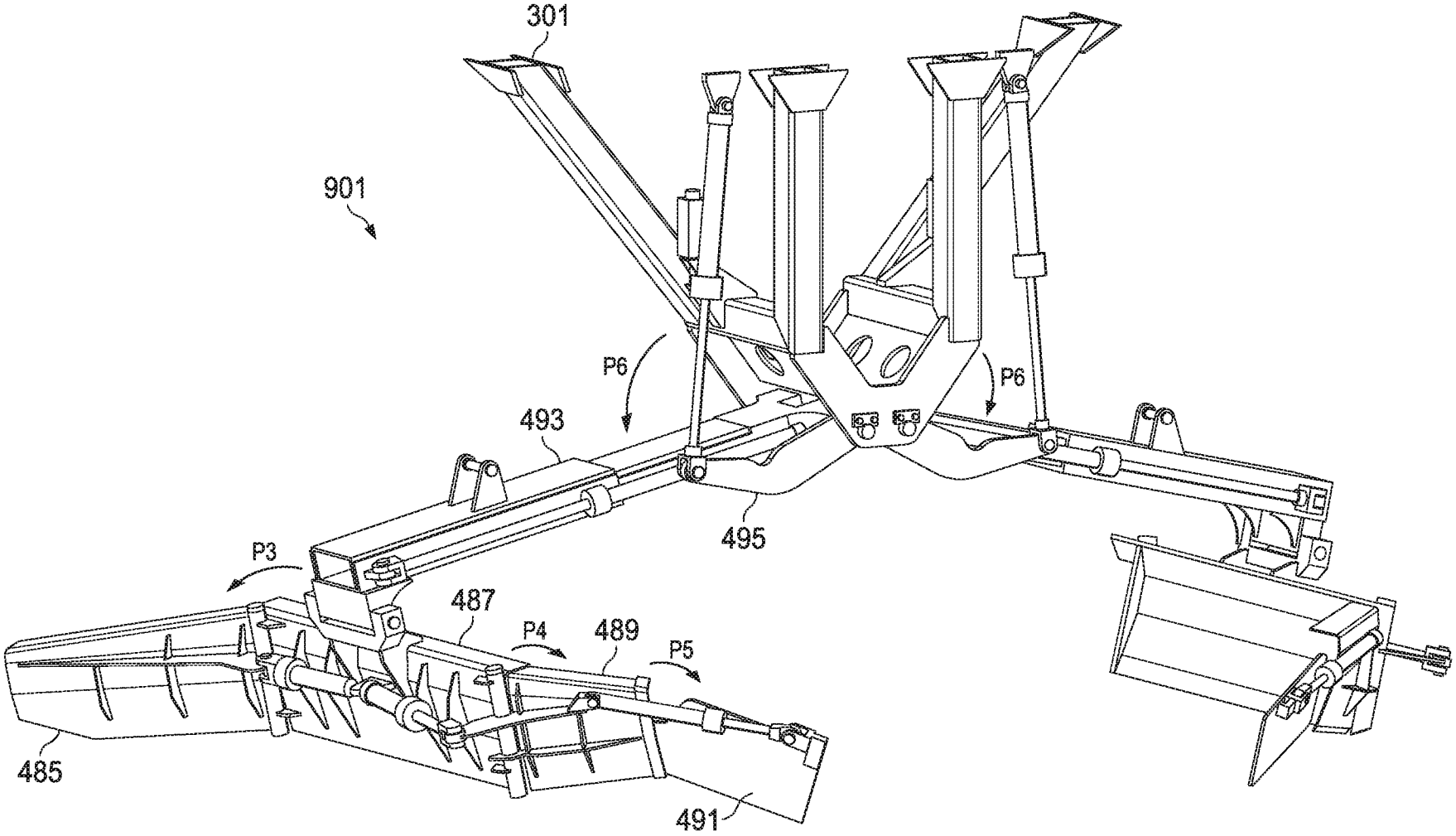
FIG. 9 is a rear, isometric view of an embodiment of a plow for the operations car, and is shown in an extended or operational position.
Figure 10:
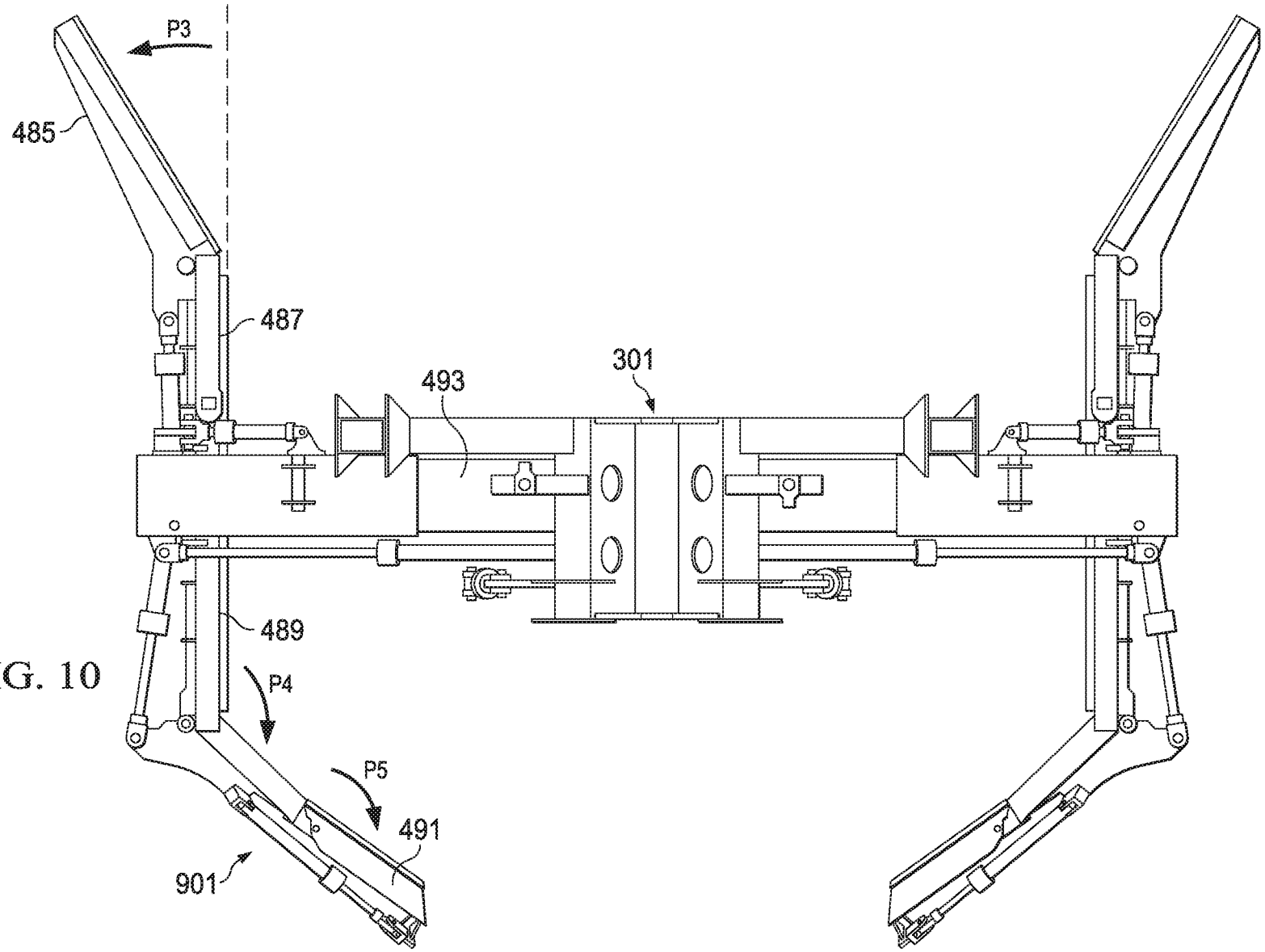
FIG. 10 is a top view of the plow of FIG. 9.
Figure 11:
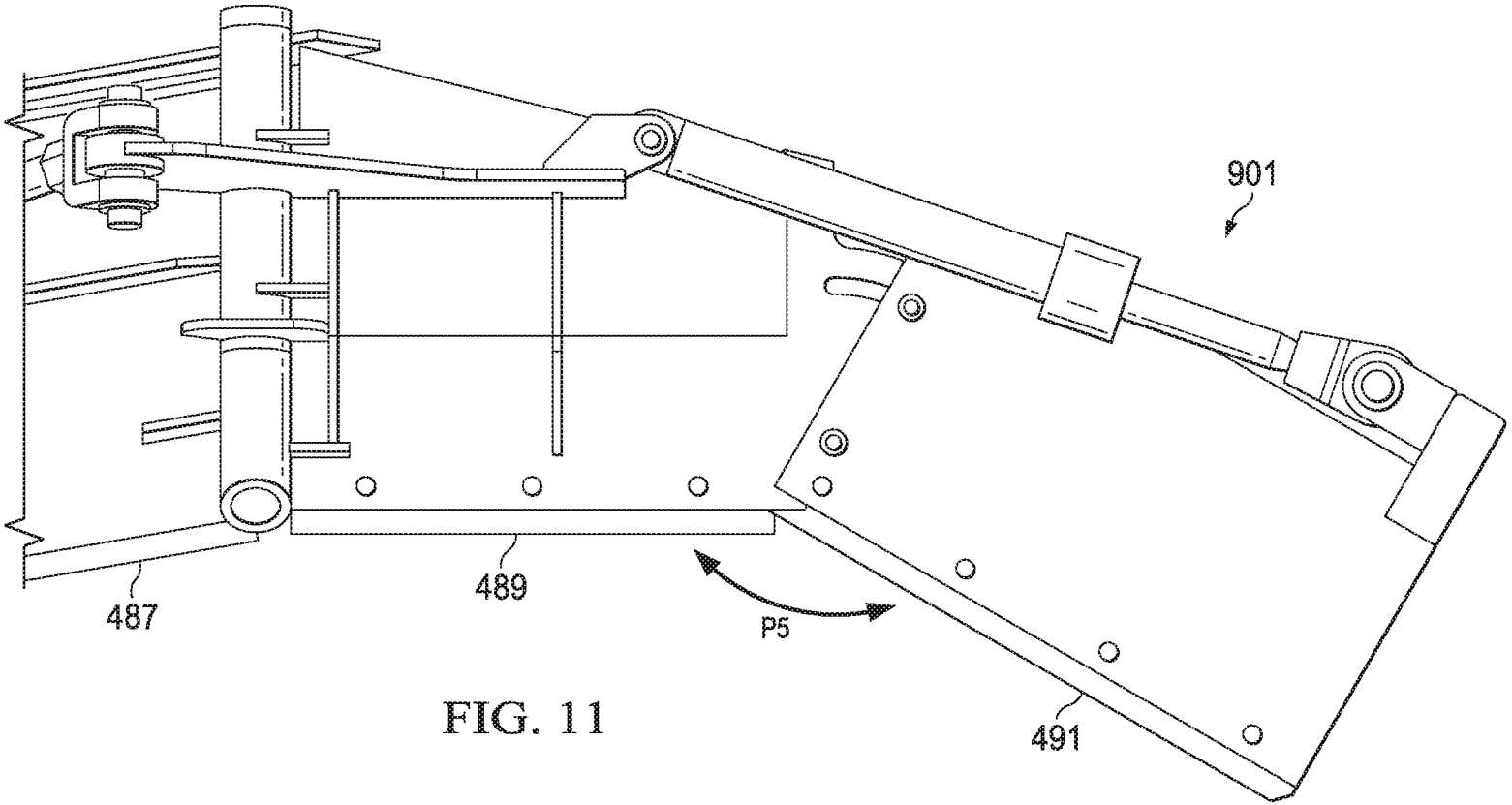
FIG. 11 is lateral side view of a rear portion of the plow of FIG. 9.
Figure 12:
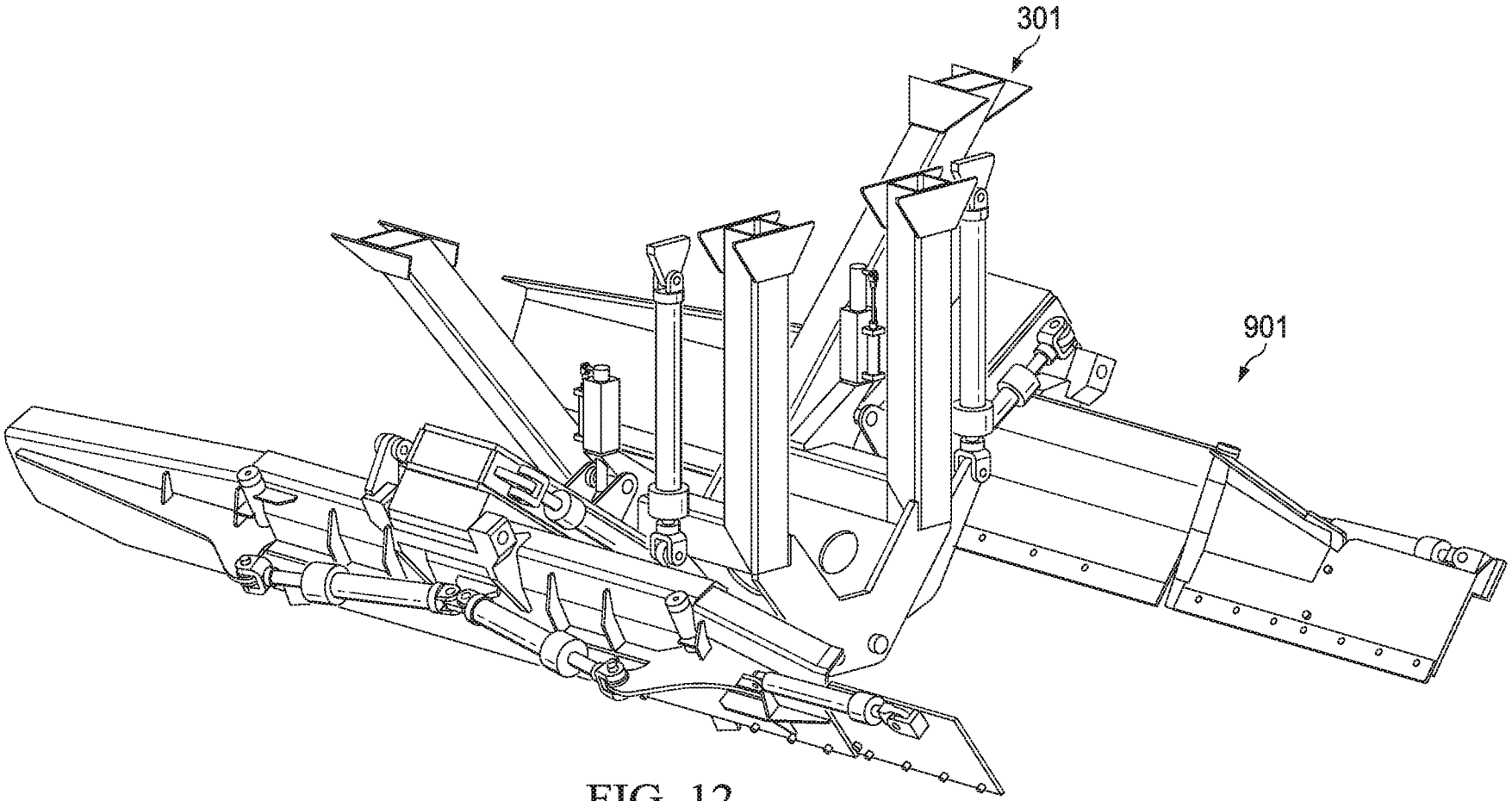
FIG. 12 is a rear isometric view of the plow of FIG. 9 in a retracted or non-operational position.
Figure 13:
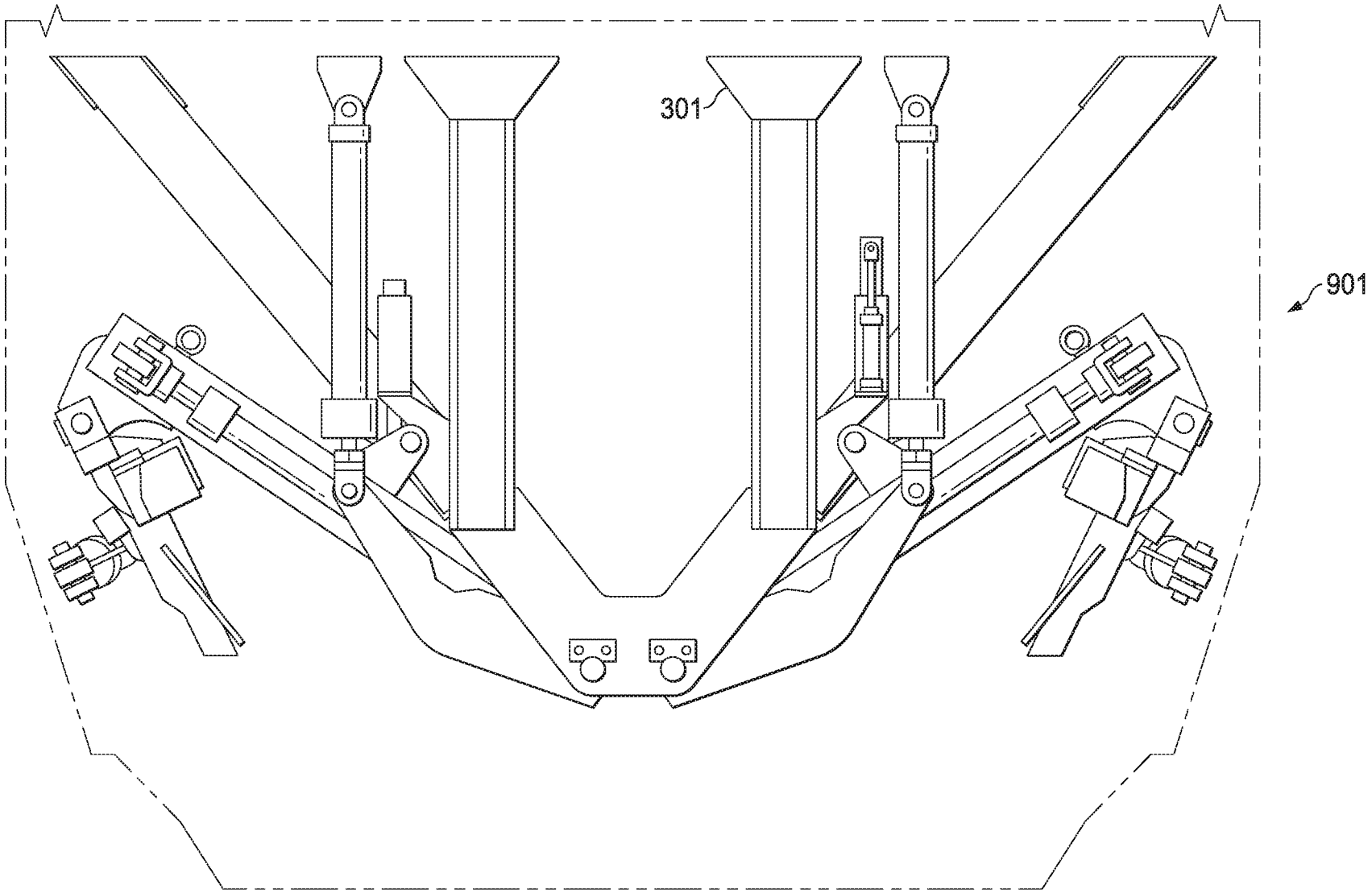
FIG. 13 is a front view of the plow of FIG. 12.

Examples of the operations car 301 can include at least one of first or second tie extractors 701 (FIGS. 1, 7 and 8) on opposite sides of the operations car 301. Each of the first and second tie extractors 701 can be configured to extract one tie 106 at a time from the railroad 102 while the track 105 is elevated above the rail bed 103. The tie extractors 701 can be configured to remove drop ties. As used herein, the term "drop tie" can refer to a tie 106 that partially or completely drops from one or both rails of a railroad 102 while the track 105 is lifted out of the ballast of the rail bed 103.

In some embodiments, each of the first and second tie extractors 701 can include a first degree of freedom for a gripper 705 in a gripper direction GD to grip a tie 106 of the railroad 102. Examples can further include a second degree of freedom for an arm extension 707 in the arm extension direction AED that is lateral to the railroad 102. Still other versions can include a third degree of freedom to pivot P1 the arm extension 707 relative to a second arm 709. Embodiments can include a fourth degree of freedom to pivot P2 the second arm 709 relative to the operations car 301. In addition, the operation car 301 can include a mount 711 for slidably moving each of the first and second tie extractors 701 in a fifth degree of freedom in a moving direction MD. For example, each of the first and second tie extractors 701 can be slidably mounted to axles 703 (FIG. 7) extending in the working direction, such that entireties of the first and second tie extractors 701 are movable in or opposite to the working direction.

As shown in FIGS. 9-13, the railroad apparatus 101 can include the second plow 901 located rearward of the grader 451 relative to the working direction. Embodiments of the second plow 901 can be configured to move the ballast of the rail bed 103 toward the railroad 102. In other examples, an entirety of the second plow 901 can be movable in or opposite to the working direction, relative to the operations car 301. Embodiments of the second plow 901, relative to the working direction, can include a front plow 485 having a first degree of freedom for pivoting P3 relative to a plow assembly 487.

Additionally, the second plow 901 can include a rear plow 489 having a second degree of freedom for pivoting P4 relative to the plow assembly 487 can be provided. In other versions, a tail plow 491 having a third degree of freedom for pivoting P5 relative to the rear plow 489 can be provided. Examples of the second plow 901 can include an arm 493 having a fourth degree of freedom for moving the plow assembly 487 in a lateral direction relative to the working direction. Moreover, the second plow 901 can have a lever 495 with a fifth degree of freedom for pivoting P6 the arm 493 relative to the operations car 301. As shown throughout the drawings, the components, capabilities and features of the second plow 901 can be provided on each side of the track 105.

The embodiments disclosed herein can lift a railroad track out of poor ballast conditions, raise the track to a desired height, and reposition and correct the track. As used herein, the term "correct the track" can be defined as removing undesirable horizontal and lateral variations in the track such that the track is properly aligned. In particular, embodiments of the device and method can be faster and more economical that conventional or traditional sled or undercutting repair techniques that slightly lift a railroad track while dragging and circulating a chain beneath the track.

Other versions may include one or more of the following embodiments:

1. A railroad apparatus for a railroad having a track in a rail bed, comprising:

an operations car comprising a grader configured to grade the rail bed beneath the track in a working direction while the track is vertically elevated above the rail bed by the operations car, the grader comprising a first degree of freedom in a lateral direction with respect to the railroad, a second degree of freedom in a vertical direction with respect to the railroad, and a third degree of freedom rotationally about a vertical axis with respect to the railroad; and a power car coupled to the operations car, the power car comprising hydraulic, pneumatic and electric systems configured to provide hydraulic power, pneumatic power and electric power, respectively, to both the operations car and the power car.

2. The railroad apparatus of any of these embodiments, wherein the operations car comprises a main lifter configured to vertically elevate the track above the rail bed, an additional lifter also configured to vertically elevate the track above the rail bed, the main lifter is located rearward of the additional lifter relative to the working direction, and the additional lifter is configured to break the railroad loose from ballast in the rail bed.

3. The railroad apparatus of any of these embodiments, further comprising a lifter cab mounted to the operations car forward of the additional lifter relative to the working direction, and a tie decoupler mounted to the operations car between the additional lifter and the lifter cab; and wherein the tie decoupler is configured to remove a tie from the railroad while the track is lifted out of the rail bed, and the tie decoupler comprises two tie decouplers with one tie decoupler adjacent each lateral side of the operations car.

4. The railroad apparatus of any of these embodiments, wherein the main lifter has a greater amount of vertical elevation capacity than the additional lifter, and the main lifter is located rearward of the additional lifter relative to the working direction.

5. The railroad apparatus of any of these embodiments, wherein the grader is substantially aligned with and mounted to the main lifter relative to the working direction.

6. The railroad apparatus of any of these embodiments, further comprising a fourth degree of freedom wherein entireties of both the grader and the main lifter are movable in transverse directions relative to the working direction.

7. The railroad apparatus of any of these embodiments, further comprising first and second tie extractors on opposite sides of the operations car, and each of the first and second tie extractors is configured to extract ties from the railroad while the track is elevated above the rail bed.

8. The railroad apparatus of any of these embodiments, wherein each of the first and second tie extractors are slidably mounted to axles extending in the working direction, such that entireties of the first and second tie extractors are movable in the working direction.

9. The railroad apparatus of any of these embodiments, wherein each of the first and second tie extractors comprises a first degree of freedom in a gripper direction to grip a tie, a second degree of freedom in an arm extension direction lateral to the railroad, a third degree of freedom to pivot the arm extension relative to a second arm, a fourth degree of freedom to pivot the second arm relative to the operations car, and the slidably mounts of each of the first and second tie extractors are a fifth degree of freedom.

10. The railroad apparatus of any of these embodiments, wherein the device is configured to move at a railroad repair speed of at least about 1.5 miles per hour (mph).

11. The railroad apparatus of any of these embodiments, wherein the device is configured to vertically lift the track from its original vertical height by at least about 16 inches.

12. The railroad apparatus of any of these embodiments, wherein the railroad apparatus consists of eight drive axles having wheels, and each drive axle is individually and selectively drivable by the power car.

13. The railroad apparatus of any of these embodiments, wherein the power car comprises a track stabilizer that is fully integrated into the power car and has in-situ workheads that are configured to apply selected horizontal vibration and a vertical load to the railroad while the railroad apparatus is in operation, such that the track stabilizer can settle ballast in the rail bed and loosen debris from the track, while the track is elevated above the rail bed.

14. The railroad apparatus of any of these embodiments, wherein the operations car is configured to substantially remove tie memory in the ballast due to previous locations of the ties lifted from the rail bed, and the operations car is configured to lower the track to a top of the rail bed to skeletonize the track.

15. The railroad apparatus of any of these embodiments, wherein the grader does not comprise a chain.

16. The railroad apparatus of any of these embodiments, wherein the grader is not rotated while the rail bed is being graded.

17. The railroad apparatus of any of these embodiments, wherein, during grading, the grader does not intentionally on-board the rail bed, does not intentionally sift the rail bed, and does not intentionally off-board sifted rail bed.

18. The railroad apparatus of any of these embodiments, wherein, during grading, the grader is configured to contact only a limited vertical depth of a ballast of the rail bed, and to not contact and disrupt a hard pack of the rail bed that supports the ballast.

19. The railroad apparatus of any of these embodiments, wherein the grader comprises two graders that are spaced apart from each other on opposite sides of the operations car.

20. The railroad apparatus of any of these embodiments, wherein each grader comprises a vertical dimension that varies laterally with respect to the railroad.

21. The railroad apparatus of any of these embodiments, wherein a distal end of each grader comprises a larger vertical dimension than a proximal end of each grader.

22. The railroad apparatus of any of these embodiments, wherein the railroad apparatus consists of only the operations car and the power car.

23. The railroad apparatus of any of these embodiments, further comprising a first plow located forward of the grader relative to the working direction, wherein the first plow is configured to move a ballast of the rail bed adjacent ends of ties of the railroad away from the ties.

24. The railroad apparatus of any of these embodiments, further comprising a second plow located rearward of the grader relative to the working direction, wherein the second plow is configured to move a ballast of the rail bed toward the railroad.

25. The railroad apparatus of any of these embodiments, wherein an entirety of the second plow is movable in the working direction, and opposite to the working direction, relative to the operations car.

26. The railroad apparatus of any of these embodiments, wherein the second plow, relative to the working direction, comprises a front plow having a first degree of freedom for pivoting relative to a plow assembly, a rear plow having a second degree of freedom for pivoting relative to the plow assembly, a tail plow having a third degree of freedom for pivoting relative to the rear plow, an arm having a fourth degree of freedom for moving the plow assembly in a lateral direction relative to the working direction, and a lever having a fifth degree of freedom for pivoting the arm relative to the operations car.

27. The railroad apparatus of any of these embodiments, wherein each of the tie decouplers, tie extractors, sides of the first plow, graders and sides of the second plow are independently actuatable relative to each other through respective degrees of freedom.

28. A railroad apparatus for a railroad having a track in a rail bed, comprising:

an operations car comprising a main lifter configured to vertically elevate the track above the rail bed, an additional lifter also configured to vertically elevate the track above the rail bed, and first and second tie extractors on opposite sides of the operations car, and each of the first and second tie extractors is configured to extract ties from the railroad while the track is elevated above the rail bed; and a power car coupled to the operations car, the power car comprising hydraulic, pneumatic and electric systems configured to provide hydraulic power, pneumatic power and electric power, respectively, to both the operations car and the power car.

29. A railroad apparatus for a railroad having a track in a rail bed, comprising:

an operations car comprising a grader configured to grade the rail bed beneath the track while the track is vertically elevated above the rail bed by the operations car, the grader comprising a first degree of freedom in a lateral direction with respect to the railroad, a second degree of freedom in a vertical direction with respect to the railroad, and a third degree of freedom rotationally about a vertical axis with respect to the railroad;

a power car coupled to the operations car, the power car comprising hydraulic, pneumatic and electric systems configured to provide hydraulic power, pneumatic power and electric power, respectively, to both the operations car and the power car, and the power car comprises a track stabilizer that is fully integrated into the power car and has in-situ workheads that are configured to apply selected horizontal vibration and a vertical load to the railroad while the railroad apparatus is in operation, such that the track stabilizer can settle ballast in the rail bed and loosen debris from the track, while the track is elevated above the rail bed; and the railroad apparatus consists of only the operations car and the power car.

This written description uses examples to disclose the embodiments, including the best mode, and also to enable those of ordinary skill in the art to make and use the invention. The patentable scope is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal languages of the claims.

Note that not all of the activities described above in the general description or the examples are required, that a portion of a specific activity may not be required, and that one or more further activities may be performed in addition to those described. Still further, the order in which activities are listed are not necessarily the order in which they are performed.

In the foregoing specification, the concepts have been described with reference to specific embodiments. However, one of ordinary skill in the art appreciates that various modifications and changes can be made without departing from the scope of the invention as set forth in the claims below. Accordingly, the specification and figures are to be regarded in an illustrative rather than a restrictive sense, and all such modifications are intended to be included within the scope of invention.

It may be advantageous to set forth definitions of certain words and phrases used throughout this patent document. The term "communicate," as well as derivatives thereof, encompasses both direct and indirect communication. The terms "include" and "comprise," as well as derivatives thereof, mean inclusion without limitation. The term "or" is inclusive, meaning and/or. The phrase "associated with," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, have a relationship to or with, or the like. The phrase "at least one of," when used with a list of items, means that different combinations of one or more of the listed items may be used, and only one item in the list may be needed. For example, "at least one of: A, B, and C" includes any of the following combinations: A, B, C, A and B, A and C, B and C, and A and B and C.

Also, the use of "a" or "an" are employed to describe elements and components described herein. This is done merely for convenience and to give a general sense of the scope of the invention. This description should be read to include one or at least one and the singular also includes the plural unless it is obvious that it is meant otherwise.

The description in the present application should not be read as implying that any particular element, step, or function is an essential or critical element that must be included in the claim scope. The scope of patented subject matter is defined only by the allowed claims. Moreover, none of the claims invokes 35 U.S.C. § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. § 112(f).

Benefits, other advantages, and solutions to problems have been described above with regard to specific embodiments. However, the benefits, advantages, solutions to problems, and any feature(s) that may cause any benefit, advantage, or solution to occur or become more pronounced are not to be construed as a critical, required, or essential feature of any or all the claims.

After reading the specification, skilled artisans will appreciate that certain features are, for clarity, described herein in the context of separate embodiments, may also be provided in combination in a single embodiment. Conversely, various features that are, for brevity, described in the context of a single embodiment, may also be provided separately or in any subcombination. Further, references to values stated in ranges include each and every value within that range.

What is claimed is:

1. A railroad apparatus for a railroad having a track in a rail bed, comprising:

an operations car comprising a grader configured to grade the rail bed beneath the track in a working direction while the track is vertically elevated above the rail bed by the operations car, the grader comprising a first degree of freedom in a lateral direction with respect to the railroad, a second degree of freedom in a vertical direction with respect to the railroad, and a third degree of freedom rotationally about a vertical axis with respect to the railroad; and a power car coupled to the operations car, the power car comprising hydraulic, pneumatic and electric systems configured to provide hydraulic power, pneumatic power and electric power, respectively, to both the operations car and the power car.

2. The railroad apparatus of claim 1, wherein the operations car comprises a main lifter configured to vertically elevate the track above the rail bed, an additional lifter also configured to vertically elevate the track above the rail bed, the main lifter is located rearward of the additional lifter relative to the working direction, and the additional lifter is configured to break the railroad loose from ballast in the rail bed.

3. The railroad apparatus of claim 2, further comprising a lifter cab mounted to the operations car forward of the additional lifter relative to the working direction, and a tie decoupler mounted to the operations car between the additional lifter and the lifter cab; and wherein the tie decoupler is configured to remove a tie from the track while the track is lifted out of the rail bed, and a tie decoupler assembly comprises two tie decouplers with one tie decoupler adjacent each lateral side of the operations car.

4. The railroad apparatus of claim 2, wherein the main lifter has a greater amount of vertical elevation capacity than the additional lifter, and the main lifter is located rearward of the additional lifter relative to the working direction.

5. The railroad apparatus of claim 2, wherein the grader is substantially aligned with and mounted to the main lifter relative to the working direction.

6. The railroad apparatus of claim 5, further comprising a fourth degree of freedom wherein entireties of both the grader and the main lifter are movable in transverse directions relative to the working direction.

7. The railroad apparatus of claim 1, further comprising first and second tie extractors on opposite sides of the operations car, and each of the first and second tie extractors is configured to extract ties from the railroad while the track is elevated above the rail bed.

8. The railroad apparatus of claim 7, wherein each of the first and second tie extractors are slidably mounted to axles extending in the working direction, such that entireties of the first and second tie extractors are movable in the working direction.

9. The railroad apparatus of claim 8, wherein each of the first and second tie extractors comprises a first degree of freedom in a gripper direction to grip a tie, a second degree of freedom in an arm extension direction lateral to the railroad, a third degree of freedom to pivot the arm extension relative to a second arm, a fourth degree of freedom to pivot the second arm relative to the operations car, and a mount for slidably moving each of the first and second tie extractors in a moving direction comprises a fifth degree of freedom.

10. The railroad apparatus of claim 1, wherein the device is configured to move at a railroad repair speed of at least about 1.5 miles per hour (mph).

11. The railroad apparatus of claim 1, wherein the apparatus is configured to vertically lift the track from its original vertical height by at least about 16 inches.

12. The railroad apparatus of claim 1, wherein the railroad apparatus consists of eight drive axles having wheels, and each drive axle is individually and selectively drivable by the power car.

13. The railroad apparatus of claim 1, wherein the power car comprises a track stabilizer that is fully integrated into the power car and has in-situ workheads that are configured to apply selected horizontal vibration and a vertical load to the railroad while the railroad apparatus is in operation, such that the track stabilizer can settle ballast in the rail bed and loosen debris from the track, while the track is elevated above the rail bed.

14. The railroad apparatus of claim 1, wherein the operations car is configured to substantially remove tie memory in ballast due to previous locations of the ties lifted from the rail bed, and the operations car is configured to lower the track to a top of the rail bed to skeletonize the track.

15. The railroad apparatus of claim 1, wherein the grader does not comprise a chain.

16. The railroad apparatus of claim 1, wherein the grader is not rotated while the rail bed is being graded.

17. The railroad apparatus of claim 1, wherein, during grading, the grader does not intentionally on-board the rail bed, does not intentionally sift the rail bed, and does not intentionally off-board sifted rail bed.

18. The railroad apparatus of claim 1, wherein, during grading, the grader is configured to contact only a limited vertical depth of a ballast of the rail bed, and to not contact and disrupt a hard pack of the rail bed that supports the ballast.

19. The railroad apparatus of claim 1, wherein a grader assembly comprises two graders that are spaced apart from each other on opposite sides of the operations car.

20. The railroad apparatus of claim 19, wherein each grader of the grader assembly comprises a vertical dimension that varies laterally with respect to the railroad.

21. The railroad apparatus of claim 19, wherein a distal end of each grader of the grader assembly comprises a larger vertical dimension than a proximal end of each grader.

22. The railroad apparatus of claim 1, wherein the railroad apparatus consists of only the operations car and the power car.

23. The railroad apparatus of claim 1, further comprising a first plow located forward of the grader relative to the working direction, wherein the first plow is configured to move a ballast of the rail bed adjacent ends of ties of the railroad away from the ties.

24. The railroad apparatus of claim 1, further comprising a second plow located rearward of the grader relative to the working direction, wherein the second plow is configured to move a ballast of the rail bed toward the railroad.

25. The railroad apparatus of claim 24, wherein an entirety of the second plow is movable in the working direction, and opposite to the working direction, relative to the operations car.

26. The railroad apparatus of claim 24, wherein the second plow, relative to the working direction, comprises a front plow having a first degree of freedom for pivoting relative to a plow assembly, a rear plow having a second degree of freedom for pivoting relative to the plow assembly, a tail plow having a third degree of freedom for pivoting relative to the rear plow, an arm having a fourth degree of freedom for moving the plow assembly in a lateral direction relative to the working direction, and a lever having a fifth degree of freedom for pivoting the arm relative to the operations car.

27. The railroad apparatus of claim 1, wherein each of a tie decoupler, a tie extractor, a side of a first plow, the grader and a side of a second plow are independently actuatable relative to each other through respective degrees of freedom.

28. A railroad apparatus for a railroad having a track in a rail bed, comprising:

an operations car comprising a main lifter configured to vertically elevate the track above the rail bed, an additional lifter also configured to vertically elevate the track above the rail bed, and first and second tie extractors on opposite sides of the operations car, and each of the first and second tie extractors is configured to extract ties from the railroad while the track is elevated above the rail bed; and a power car coupled to the operations car, the power car comprising hydraulic, pneumatic and electric systems configured to provide hydraulic power, pneumatic power and electric power, respectively, to both the operations car and the power car.

29. A railroad apparatus for a railroad having a track in a rail bed, comprising:

an operations car comprising a grader configured to grade the rail bed beneath the track while the track is vertically elevated above the rail bed by the operations car, the grader comprising a first degree of freedom in a lateral direction with respect to the railroad, a second degree of freedom in a vertical direction with respect to the railroad, and a third degree of freedom rotationally about a vertical axis with respect to the railroad;

a power car coupled to the operations car, the power car comprising hydraulic, pneumatic and electric systems configured to provide hydraulic power, pneumatic power and electric power, respectively, to both the operations car and the power car, and the power car comprises a track stabilizer that is fully integrated into the power car and has in-situ workheads that are configured to apply selected horizontal vibration and a vertical load to the railroad while the railroad apparatus is in operation, such that the track stabilizer can settle ballast in the rail bed and loosen debris from the track, while the track is elevated above the rail bed; and the railroad apparatus consists of only the operations car and the power car.

* * * * *